US010738779B2

(12) United States Patent
Katayama et al.

(10) Patent No.: US 10,738,779 B2
(45) Date of Patent: Aug. 11, 2020

(54) ROTARY COMPRESSOR

(71) Applicant: FUJITSU GENERAL LIMITED, Kanagawa (JP)

(72) Inventors: Hiroki Katayama, Kanagawa (JP); Naoya Morozumi, Kanagawa (JP); Yasuyuki Izumi, Kanagawa (JP); Taku Morishita, Kanagawa (JP); Motonobu Furukawa, Kanagawa (JP)

(73) Assignee: FUJITSU GENERAL LIMITED, Kanagawa (JP)

( * ) Notice: Subject to any disclaimer, the term of this patent is extended or adjusted under 35 U.S.C. 154(b) by 331 days.

(21) Appl. No.: 15/646,531

(22) Filed: Jul. 11, 2017

(65) Prior Publication Data

US 2018/0017057 A1 Jan. 18, 2018

(30) Foreign Application Priority Data

Jul. 14, 2016 (JP) ..... 2016-139651

(51) Int. Cl.
*F04C 18/356* (2006.01)
*F04C 23/00* (2006.01)
*F04C 29/00* (2006.01)

(52) U.S. Cl.
CPC ..... *F04C 18/356* (2013.01); *F04C 23/003* (2013.01); *F04C 23/008* (2013.01); (Continued)

(58) Field of Classification Search
CPC ..... F04C 18/356; F04C 23/001–003; F04C 23/008; F04C 29/0007; F04C 29/0057; (Continued)

(56) References Cited

U.S. PATENT DOCUMENTS 4,726,739 A * 2/1988 Saitou ..... F04C 18/3564 417/286
4,826,408 A * 5/1989 Inoue ..... F04C 23/001 29/467

(Continued)

FOREIGN PATENT DOCUMENTS

CN 101072951 A 11/2007
CN 102102668 A 6/2011

(Continued)

OTHER PUBLICATIONS

Extended European Search Report issued in corresponding European Patent Application No. 17180964.3, dated Nov. 17, 2017.

(Continued)

*Primary Examiner* — Alexander B Comley
(74) *Attorney, Agent, or Firm* — McDermott Will & Emery LLP

(57) ABSTRACT

In a rotary compressor, a lower end plate cover is formed in a shape of a flat plate, and has a through hole that is provided to penetrate in the thickness direction of the lower end plate cover and that communicates with a communication groove. When a sectional area of the communication groove which passes through a center line of a rotation shaft, and is on a section along the rotation shaft direction is S1 [$mm^2$], an area in which the through hole and the communication groove overlap each other on a plane orthogonal to the rotation shaft is S2 [$mm^2$], and an excluding capacity of a lower cylinder chamber is V [cc], each of $0.10 \leq (S2/V) \leq 0.50$, and $1.0 \leq (S2/S1) \leq 7.0$ is satisfied.

5 Claims, 12 Drawing Sheets

(52) U.S. Cl.
CPC ..... *F04C 29/0057* (2013.01); *F04C 29/0085* (2013.01); *F04C 2210/26* (2013.01); *F04C 2230/21* (2013.01); *F04C 2240/30* (2013.01); *F04C 2240/40* (2013.01); *F04C 2240/805* (2013.01)

(58) Field of Classification Search
CPC ..... F04C 29/0085; F04C 29/021; F04C 29/026–028; F04C 18/3562; F04C 18/3564; F04C 29/12
USPC ..... 418/60; 417/410.3
See application file for complete search history.

(56) References Cited

U.S. PATENT DOCUMENTS 4,990,073 A * 2/1991 Kudo ..... F04C 18/3564 181/272
5,152,156 A * 10/1992 Tokairin ..... F04C 18/3564 417/286
5,242,280 A * 9/1993 Fujio ..... F04C 18/3564 418/11
5,542,831 A * 8/1996 Scarfone ..... F04C 18/3562 418/60
5,586,876 A * 12/1996 Yasnnascoli ..... F04C 29/025 418/60
6,907,746 B2 * 6/2005 Sato ..... F04C 18/3564 417/247
7,780,427 B2 * 8/2010 Ueda ..... F04C 18/356 418/11
7,798,791 B2 * 9/2010 Byun ..... F01C 21/0863 418/15
7,841,838 B2 * 11/2010 Kawabe ..... F04C 28/065 417/212
7,988,431 B2 * 8/2011 Byun ..... F01C 21/0863 417/286
8,251,683 B2 * 8/2012 Byun ..... F01C 21/0863 417/213
8,356,986 B2 * 1/2013 Higashi ..... F04C 18/322 417/307
8,419,380 B2 * 4/2013 Ko ..... F04B 39/123 417/250
8,517,702 B2 * 8/2013 Byun ..... F01C 21/0863 285/50
9,004,888 B2 * 4/2015 Morishita ..... F04C 18/22 418/60
2008/0085205 A1 * 4/2008 Tamaoki ..... F04C 23/008 418/61.1
2008/0240954 A1 * 10/2008 Morozumi ..... F04C 18/3564 418/13
2011/0023535 A1 * 2/2011 Morimoto ..... C09K 5/045 62/510
2011/0150683 A1 * 6/2011 Lee ..... F04C 18/086 418/5
2014/0099218 A1 * 4/2014 Hiwata ..... F04C 29/12 417/410.3
2014/0186201 A1 * 7/2014 Moon ..... F01C 21/08 417/410.3
2014/0219851 A1 * 8/2014 Hikichi ..... F04C 29/028 418/60
2015/0040608 A1 * 2/2015 Nam ..... F04C 2/3564 62/498
2015/0233376 A1 8/2015 Ogata et al.
2017/0138360 A1 5/2017 Gao et al.

FOREIGN PATENT DOCUMENTS

CN 203500020 U 3/2014
CN 204941496 U 1/2016
EP 1 820 970 A1 8/2007
EP 2 339 179 A2 6/2011
JP H11-13664 A 1/1999
JP 2014-145318 A 8/2014
WO 2013/094114 A1 6/2013
WO 2016/086396 A1 6/2016
WO 2016/098710 A1 6/2016

OTHER PUBLICATIONS

Chinese Office Action issued in corresponding Chinese Patent Application No. 201710546620.9, dated Jan. 6, 2020, with English translation.
Japanese Office Action issued in corresponding Japanese Patent Application No. 2016-139651, dated Apr. 7, 2020, with English translation.

* cited by examiner

ROTARY COMPRESSOR

CROSS-REFERENCE TO RELATED APPLICATION

This application is based upon and claims the benefit of priorities from Japanese Patent Application No. 2016-139651 filed on Jul. 14, 2016, the entire contents of which are incorporated herein by reference.

FIELD

The present invention relates to a two-cylinder type rotary compressor.

BACKGROUND

In a two-cylinder type rotary compressor, a refrigerant path hole through which a high-temperature compressed refrigerant that is compressed in a lower cylinder and is discharged from a lower discharge hole flows toward an upper end plate cover chamber (upper muffler chamber) from a lower end plate cover chamber (lower muffler chamber), is disposed at a position separated from an inlet chamber side of the lower cylinder and an upper cylinder. Accordingly, a technology which suppresses heating of a suctioned refrigerant on the inlet chamber side of the lower cylinder and the upper cylinder due to the compressed refrigerant, and in which compressor efficiency is improved, is known.

In addition, in the two-cylinder type rotary compressor, a technology which suppresses heating of the lower end plate and heating of the suctioned refrigerant on the inside of the inlet chamber of the lower cylinder due to the high-temperature compressed refrigerant that is compressed in the lower cylinder and is discharged from the lower discharge hole, and in which compressor efficiency is improved, is known.

In a rotary compressor described in JP-A-2014-145318, as a lower end plate cover (lower muffler cover) inflates, capacity of a lower end plate cover chamber formed between a lower end plate and the lower end plate cover becomes greater. Therefore, an amount of a refrigerant which is compressed in an upper cylinder, is discharged from an upper discharge hole, flows backward through a refrigerant path hole, and flows into a lower muffler chamber, is large.

In a rotary compressor described in International Publication No. 2013/094114, a refrigerant path hole is disposed on a side opposite to a lower discharge valve accommodation portion with respect to a lower discharge hole provided in a lower end plate, a refrigerant discharged from the lower discharge hole flows to the refrigerant path hole through the lower discharge valve accommodation portion, and accordingly, it is necessary to deepen the lower discharge valve accommodation portion. Therefore, capacity of a lower end plate cover chamber (refrigerant discharge space) increases, and an amount of the refrigerant which is compressed in an upper cylinder, is discharged from the upper discharge hole, flows backward through the refrigerant path hole, and flows into a lower muffler chamber, is large.

Hereinafter, the above-described backflow phenomenon of the refrigerant will be described. In a two-cylinder type rotary compressor, in order to reduce a fluctuation in torque per one rotation of a rotation shaft to be as small as possible, in general, a process of suctioning, compressing, and discharging is performed with phases different by 180° in two cylinders. Excluding a special operating condition, such as a condition at the time when staring an operation, in an operation of an air conditioner at a general outdoor temperature and an indoor temperature, the discharge process of one cylinder is approximately ⅓ of one rotation of the rotation shaft. Therefore, ⅓ of one rotation is a discharge process (process in which a discharge valve is open) of one cylinder, and the other ⅓ of the rotation is a process of discharging of the other cylinder, and remaining ⅓ of the rotation is a process in which both of the discharge valves of two cylinders are closed.

Here, when both of the discharge valves of two cylinders are closed, and the refrigerant discharged from the compression chamber does not flow, pressures of an upper end plate cover chamber and a lower end plate cover chamber become the same pressure on the inside of a compressor housing on the outside of the upper end plate cover chamber. In the discharge process of one cylinder, among high-pressure compressed regions, the pressure of the compression chamber which is on the most upstream side of the flow of the refrigerant is the highest, and then, the pressures of the upper end plate cover chamber and the inside of the compressor housing on the outside of the upper end plate cover chamber, are high in order. Therefore, immediately after the discharge valve of the upper cylinder is open, the pressure of the upper end plate cover chamber becomes higher than the pressure of the inside of the compressor housing on the outside of the upper end plate cover chamber, or the lower end plate cover chamber. Accordingly, in the next moment, a flow of the refrigerant to the lower muffler chamber which flows backward on the inside of the compressor housing that is on the outside of the upper end plate cover chamber and the refrigerant path hole, from the upper end plate cover chamber, is generated.

The original flow of the refrigerant is a flow to the inside of the compressor housing on the outside of the upper end plate cover chamber, from the upper end plate cover chamber. However, the refrigerant which flows to the lower end plate cover chamber from the upper end plate cover chamber flows to the inside of the compressor housing on the outside of the upper end plate cover chamber through the refrigerant path hole and the upper end plate cover chamber again after finishing the discharge process of the upper cylinder, and originally, the flow is an unnecessary flow. Therefore, there is a problem that energy loss is generated and the efficiency of the rotary compressor deteriorates.

In addition, in the rotary compressor described in International Publication No. 2013/094114, heating of the lower end plate which covers a lower surface of the lower cylinder due to the refrigerant compressed in the lower cylinder, is suppressed. However, in the rotary compressor, in particular, in a state where external air is stopped for a long period of time in a low-temperature atmosphere, there is also a case where the liquefied refrigerant (liquid refrigerant) remains on the inside of the compressor housing. Since density of the liquid refrigerant at a low temperature is higher than density of lubricant oil, the liquid refrigerant remains in the lowest portion on the inside of the compressor housing. In this state, when the rotary compressor is started to be operated, the liquid refrigerant is suctioned up by an oil feeding impeller from a lower end of the rotation shaft. When the liquid refrigerant is suctioned up, since viscosity of the liquid refrigerant is lower compared to viscosity of the lubricant oil, there is a concern that defective lubrication occurs and a sliding portion of a compressing unit is damaged.

Therefore, when starting to operate the rotary compressor, it is necessary to quickly heat and gasify the liquid refrigerant. However, similar to the rotary compressor described in International Publication No. 2013/094114, in a case where the heating of the lower end plate is suppressed, gasification caused by the heating of the liquid refrigerant that remains in the lower portion of the compressor housing is suppressed, and there is a problem that damage is generated due to defective lubrication of the compressing unit as the oil feeding impeller suctions up the liquid refrigerant.

In addition, in the rotary compressor, a part of the lubricant oil on the inside of the compressor housing is entangled in the refrigerant, and is discharged to the outside of the compressor housing. The lubricant oil discharged to the outside of the compressor housing circulates a refrigerant circuit (refrigeration cycle) of the air conditioner, and is suctioned to the lower cylinder and the upper cylinder together with the suctioned refrigerant. The lubricant oil suctioned to the lower cylinder is discharged to the lower end plate cover chamber from the lower discharge hole together with the refrigerant. The lubricant oil discharged to the lower end plate cover chamber remains in the lower end plate cover chamber, and when the lower discharge hole is immersed in the lubricant oil, there is a problem that discharge resistance of the refrigerant is generated, efficiency deteriorates, and noise is generated. This problem is likely to be generated as the capacity of the lower end plate cover chamber decreases.

SUMMARY

An object of the invention is to suppress a backflow of a refrigerant compressed in an upper cylinder through a refrigerant path hole, and to suppress deterioration of efficiency of a rotary compressor.

According to an aspect of the invention, there is provided a rotary compressor including: a sealed vertically-placed cylindrical compressor housing in which a discharging unit for a refrigerant is provided in an upper portion, and an inlet unit for the refrigerant is provided in a lower portion; a compressing unit which is disposed in the lower portion of the compressor housing, and which compresses the refrigerant suctioned from the inlet portion, and which discharges the refrigerant from the discharge portion; and a motor which is disposed in the upper portion of the compressor housing, and which drives the compressing unit. The compressing unit includes an annular upper cylinder and an annular lower cylinder, an upper end plate which closes an upper side of the upper cylinder, a lower end plate which closes a lower side of the lower cylinder, an intermediate partition plate which is disposed between the upper cylinder and the lower cylinder, and which closes the lower side of the upper cylinder and the upper side of the lower cylinder, a rotation shaft which is rotated by the motor, an upper eccentric portion and a lower eccentric portion which are provided in the rotation shaft by applying a phase difference of 180° therebetween, an upper piston which is fitted to the upper eccentric portion, and which revolves along an inner circumferential surface of the upper cylinder, and which forms an upper cylinder chamber on the inside of the upper cylinder, a lower piston which is fitted to the lower eccentric portion, and which revolves along an inner circumferential surface of the lower cylinder, and which forms a lower cylinder chamber on the inside of the lower cylinder, an upper vane which protrudes to the inside of the upper cylinder chamber from an upper vane groove provided in the upper cylinder, and which divides the upper cylinder chamber into an upper inlet chamber and an upper compression chamber by abutting against the upper piston, a lower vane which protrudes to the inside of the lower cylinder chamber from a lower vane groove provided in the lower cylinder, and which divides the lower cylinder chamber into a lower inlet chamber and a lower compression chamber by abutting against the lower piston, an upper end plate cover which covers the upper end plate, and which forms an upper end plate cover chamber between the upper end plate and the upper end plate cover, and which has an upper end plate cover discharge hole that communicates with the upper end plate cover chamber and the inside of the compressor housing, a lower end plate cover which covers the lower end plate, and which forms a lower end plate cover chamber between the lower end plate and the lower end plate cover, an upper discharge hole which is provided in the upper end plate, and which communicates with the upper compression chamber and the upper end plate cover chamber, a lower discharge hole which is provided in the lower end plate, and which communicates with the lower compression chamber and the lower end plate cover chamber, and a refrigerant path hole which penetrates the lower end plate, the lower cylinder, the intermediate partition plate, the upper end plate, and the upper cylinder, and which communicates with the lower end plate cover chamber and the upper end plate cover chamber, in which a communication groove, which communicates with the lower end plate cover chamber, is provided on a mating surface between the lower end plate and the lower end plate cover, and in which the lower end plate cover is formed in a shape of a flat plate, and has a through hole that is provided to penetrate in the thickness direction of the lower end plate cover and that communicates with the communication groove. When a sectional area of the communication groove which passes through a center line of the rotation shaft, and is on a section along the rotation shaft direction is S1 [$mm^2$], an area in which the through hole and the communication groove overlap each other on a plane orthogonal to the rotation shaft is S2 [$mm^2$], and an excluding capacity of the lower cylinder chamber is V [cc], each of $0.10 \leq (S2/V) \leq 0.50$, and $1.0 \leq (S2/S1) \leq 7.0$ is satisfied.

In the invention, it is possible to suppress a backflow of the refrigerant compressed in the lower cylinder through the refrigerant path hole, and to suppress deterioration of efficiency of the rotary compressor.

DESCRIPTION OF EMBODIMENTS

Hereinafter, aspects (embodiments) for realizing the invention will be described in detail with reference to the drawings.

First Embodiment

Figure 1:
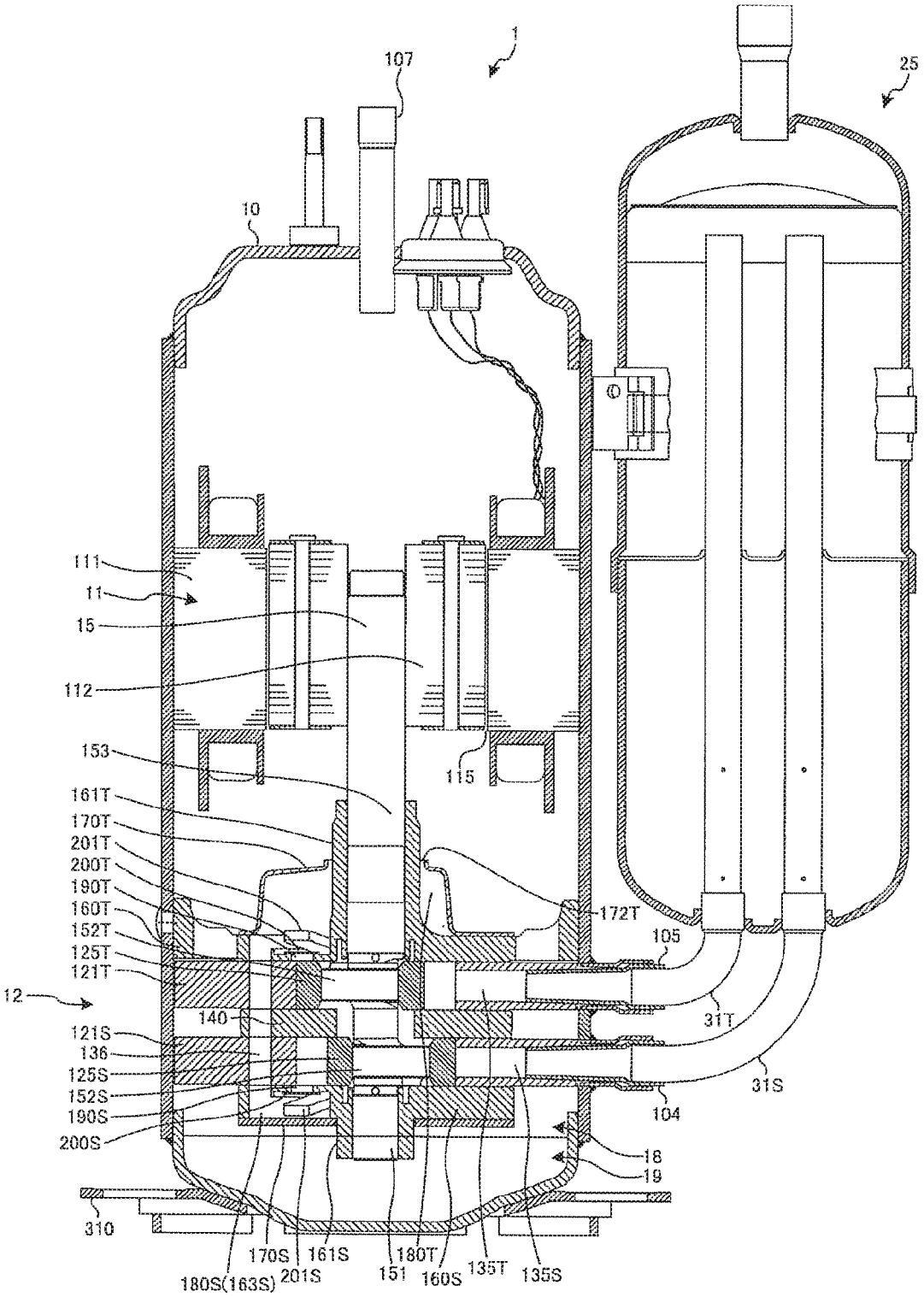
FIG. 1 is a longitudinal sectional view illustrating a rotary compressor according to a first embodiment of the invention.
Figure 2:
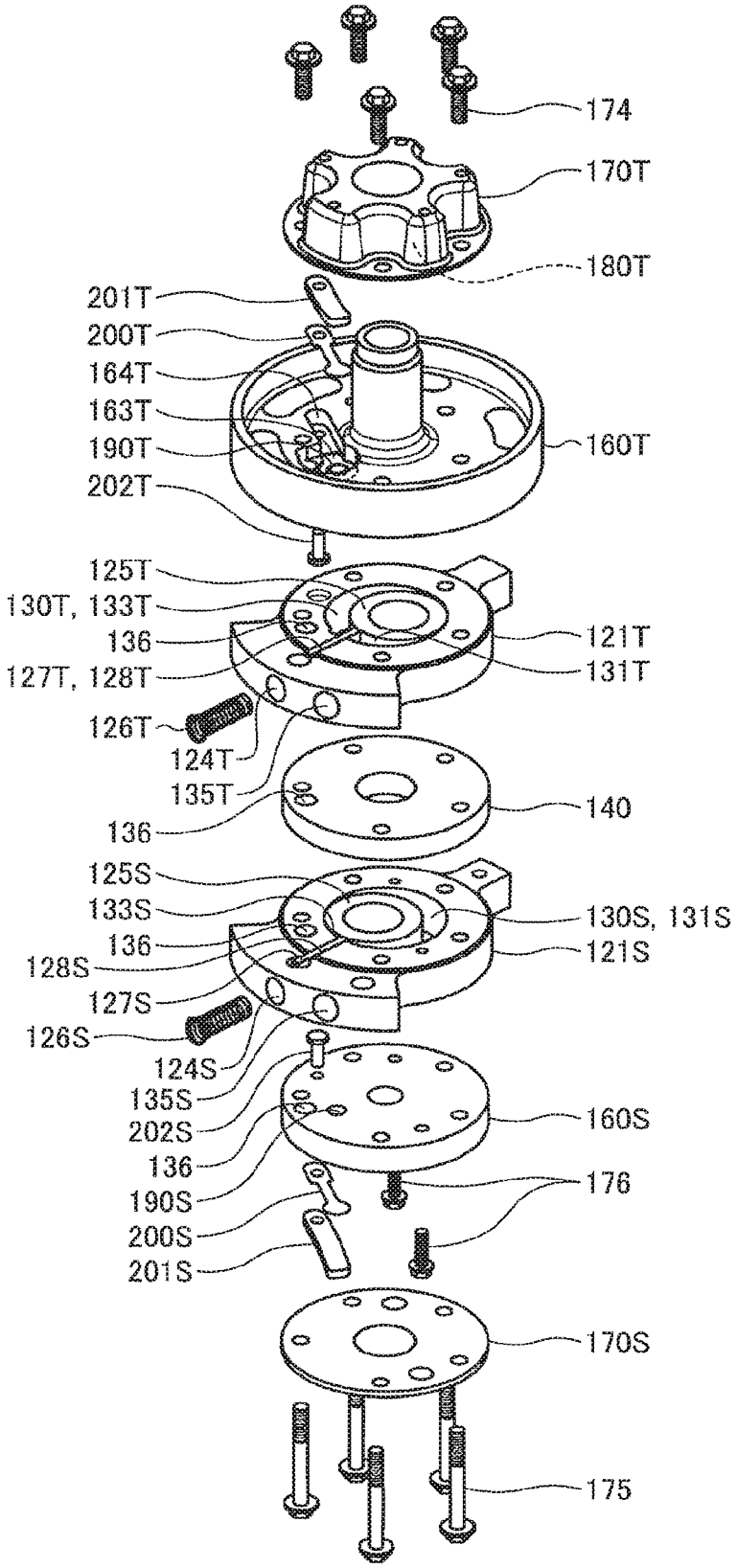
FIG. 2 is an exploded perspective view when a compressing unit of the rotary compressor according to the first embodiment is viewed from above.
Figure 3:
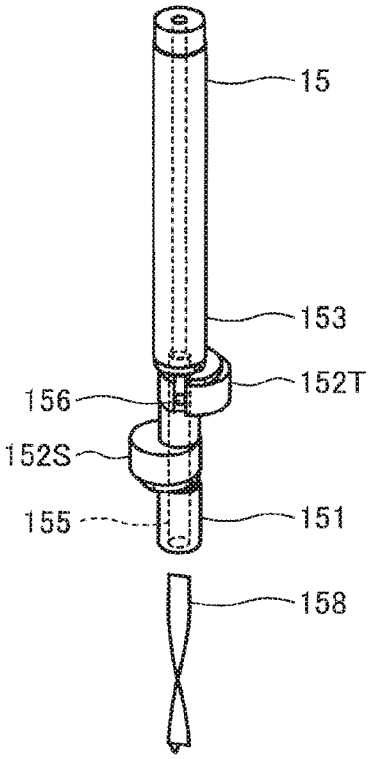
FIG. 3 is an exploded perspective view when a rotation shaft of the rotary compressor according to the first embodiment, and an oil feeding impeller, are viewed from above.

FIG. 1 is a longitudinal sectional view illustrating a first embodiment of a rotary compressor according to the invention. FIG. 2 is an exploded perspective view when a compressing unit of the rotary compressor according to the first embodiment is viewed from above. FIG. 3 is an exploded perspective view when a rotation shaft of the rotary compressor according to the first embodiment, and an oil feeding impeller, are viewed from above.

As illustrated in FIG. 1, a rotary compressor 1 includes: a compressing unit 12 which is disposed in a lower portion of the inside of a sealed vertically-placed cylindrical compressor housing 10; a motor 11 which is disposed on an upper portion of the compressing unit 12, and drives the compressing unit 12 via a rotation shaft 15; and a vertically-placed cylindrical accumulator 25 which is fixed to a side portion of the compressor housing 10.

The accumulator 25 is connected to an upper inlet chamber 131T (refer to FIG. 2) of an upper cylinder 121T via an upper inlet pipe 105 and an accumulator upper L-pipe 31T, and is connected to a lower inlet chamber 131S (refer to FIG. 2) of a lower cylinder 121S via a lower inlet pipe 104 and an accumulator lower L-pipe 31S.

The motor 11 includes a stator 111 which is disposed on an outer side, and a rotor 112 which is disposed on an inner side. The stator 111 is fixed to an inner circumferential surface of the compressor housing 10 in a shrink fit state. The rotor 112 is fixed to the rotation shaft 15 in a shrink fit state.

In the rotation shaft 15, a sub-shaft unit 151 on a lower side of a lower eccentric portion 152S is supported to be freely rotated and fitted to a sub-bearing unit 161S provided in a lower end plate 160S, and a main shaft unit 153 on an upper side of an upper eccentric portion 152T is supported to be freely rotated and fitted to a main bearing unit 161T provided in an upper end plate 160T. The rotation shaft 15 is supported to be freely rotated with respect to the entire compressing unit 12 as each of the upper eccentric portion 152T and the lower eccentric portion 152S provided by applying a phase difference of 180° therebetween is fitted to an upper piston 125T and a lower piston 125S to be freely rotated. In addition, by the rotation of the rotation shaft 15, the upper piston 125T and the lower piston 125S are operated to revolve along the inner circumferential surfaces of each of the upper cylinder 121T and the lower cylinder 121S.

On the inside of the compressor housing 10, in order to lubricate a sliding portion of the compressing unit 12, and to seal an upper compression chamber 133T (refer to FIG. 2) and a lower compression chamber 133S (refer to FIG. 2), lubricant oil 18 having an amount by which the compressing unit 12 is substantially immersed is sealed. An attachment leg 310 which locks a plurality of elastic supporting members (not illustrated) that support the entire rotary compressor 1 is fixed to a lower side of the compressor housing 10.

As described in FIG. 2, the compressing unit 12 is configured by accumulating an upper end plate cover 170T including a bulging portion in which a hollow space is formed in an inner portion, the upper end plate 160T, the upper cylinder 121T, an intermediate partition plate 140, the lower cylinder 121S, the lower end plate 160S, and a flat plate-like lower end plate cover 170S, in order from above. The entire compressing unit 12 is fixed by a plurality of penetrating bolts 174 and 175 and an auxiliary bolt 176 which are disposed on a substantially concentric circle from above and below.

In the annular upper cylinder 121T, an upper inlet hole 135T which is fitted to the upper inlet pipe 105 is provided. In the annular lower cylinder 121S, a lower inlet hole 135S which is fitted to the lower inlet pipe 104 is provided. In addition, in the upper cylinder chamber 130T of the upper cylinder 121T, the upper piston 125T is disposed. In a lower cylinder chamber 130S of the lower cylinder 121S, the lower piston 125S is disposed.

In the upper cylinder 121T, an upper vane groove 128T which extends from the upper cylinder chamber 130T to the outside in a radial shape, is provided, and in the upper vane groove 128T, an upper vane 127T is disposed. In the lower cylinder 121S, a lower vane groove 128S which extends from the lower cylinder chamber 130S to the outside in a radial shape, is provided, and in the lower vane groove 128S, a lower vane 127S is disposed.

At a position which overlaps the upper vane groove 128T from the outside surface in the upper cylinder 121T, an upper spring hole 124T is provided at a depth which does not reach the upper cylinder chamber 130T. An upper spring 126T is disposed in the upper spring hole 124T. At a position which overlaps the lower vane groove 128S from the outside surface in the lower cylinder 121S, a lower spring hole 124S is provided at a depth which does not reach the lower cylinder chamber 130S. A lower spring 126S is disposed in the lower spring hole 124S.

Upper and lower parts of the upper cylinder chamber 130T are closed by each of the upper end plate 160T and the intermediate partition plate 140. Upper and lower parts of the lower cylinder chamber 130S is closed by each of the intermediate partition plate 140 and the lower end plate 160S.

As the upper vane 127T is pressed to the upper spring 126T, and abuts against the outer circumferential surface of the upper piston 125T, the upper cylinder chamber 130T is divided into an upper inlet chamber 131T which communicates with the upper inlet hole 135T, and the upper compression chamber 133T which communicates with an upper discharge hole 190T provided in the upper end plate 160T. As the lower vane 127S is pressed to the lower spring 126S, and abuts against the outer circumferential surface of the lower piston 125S, the lower cylinder chamber 130S is divided into a lower inlet chamber 131S which communicates with the lower inlet hole 135S, and the lower compression chamber 133S which communicates with a lower discharge hole 190S provided in the lower end plate 160S.

In the upper end plate 160T, the upper discharge hole 190T which penetrates the upper end plate 160T and communicates with the upper compression chamber 133T of the upper cylinder 121T, is provided. On an outlet side of the upper discharge hole 190T, an annular upper valve seat (not illustrated) which surrounds the upper discharge hole 190T is formed. In the upper end plate 160T, an upper discharge valve accommodation concave portion 164T which extends from a position of the upper discharge hole 190T in a shape of a groove in the circumferential direction of the upper end plate 160T, is formed.

In the upper discharge valve accommodation concave portion 164T, all of a reed valve type upper discharge valve 200T and an upper discharge valve cap 201T, are accommodated. In the reed valve type upper discharge valve 200T, a rear end portion is fixed to the inside of the upper discharge valve accommodation concave portion 164T by an upper rivet 202T, and a front portion opens and closes the upper discharge hole 190T. In the upper discharge valve cap 201T, a rear end portion overlaps the upper discharge valve 200T and is fixed to the inside of the upper discharge valve accommodation concave portion 164T by the upper rivet 202T, and a curved (distorted) front portion controls an opening degree of the upper discharge valve 200T.

In the lower end plate 160S, the lower discharge hole 190S which penetrates the lower end plate 160S and communicates with the lower compression chamber 133S of the lower cylinder 121S, is provided. On an outlet side of the lower discharge hole 190S, an annular lower valve seat 191S (refer to FIG. 4) which surrounds the lower discharge hole 190S is formed. In the lower end plate 160S, a lower discharge valve accommodation concave portion 164S (refer to FIG. 4) which extends from the position of the lower discharge hole 190S in a shape of a groove in the circumferential direction of the lower end plate 160S, is formed.

In the lower discharge valve accommodation concave portion 164S, all of a reed valve type lower discharge valve 200S and a lower discharge valve cap 201S are accommodated. In the reed valve type lower discharge valve 200S, a rear end portion is fixed to the inside of the lower discharge valve accommodation concave portion 164S by a lower rivet 202S, and a front portion opens and closes the lower discharge hole 190S. In the lower discharge valve cap 201S, a rear end portion overlaps the reed valve-like lower discharge valve 200S, and is fixed to the inside of the lower discharge valve accommodation concave portion 164S by the lower rivet 202S, and a curved (distorted) front portion controls an opening degree of the lower discharge valve 200S.

Between the upper end plate 160T and the upper end plate cover 170T having a bulging portion in which a hollow space is formed on the inside, which are fixed to adhere to each other, an upper end plate cover chamber 180T is formed. Between the lower end plate 160S and the flat plate-like lower end plate cover 170S which are fixed to adhere to each other, a lower end plate cover chamber 180S is formed (the lower end plate cover chamber 180S will be described later in detail). A refrigerant path hole 136 which penetrates the lower end plate 160S, the lower cylinder 121S, the intermediate partition plate 140, and the upper end plate 160T, and the upper cylinder 121T, and communicates with the lower end plate cover chamber 180S and the upper end plate cover chamber 180T, is provided.

As illustrated in FIG. 3, in the rotation shaft 15, an oil feeding vertical hole 155 which penetrates from the lower end to the upper end is provided, and an oil feeding impeller 158 is pressed into the oil feeding vertical hole 155. In addition, on a side surface of the rotation shaft 15, a plurality of oil feeding horizontal holes 156 which communicate with the oil feeding vertical hole 155 is provided.

Hereinafter, a flow of the refrigerant due to the rotation of the rotation shaft 15 will be described. On the inside of the upper cylinder chamber 130T, the upper piston 125T which is fitted to the upper eccentric portion 152T of the rotation shaft 15 revolves along the outer circumferential surface (the inner circumferential surface of the upper cylinder 121T) of the upper cylinder chamber 130T due to the rotation of the rotation shaft 15. In the upper cylinder chamber 130T, in accordance with the revolution of the upper piston 125T, the upper inlet chamber 131T suctions the refrigerant from the upper inlet pipe 105 while enlarging capacity, and the upper compression chamber 133T compresses the refrigerant while reducing the capacity. When the pressure of the compressed refrigerant becomes higher than the pressure of the upper end plate cover chamber 180T on the outside of the upper discharge valve 200T, the upper discharge valve 200T is open, and the refrigerant is discharged to the upper end plate cover chamber 180T from the upper compression chamber 133T. The refrigerant discharged to the upper end plate cover chamber 180T is discharged to the inside of the compressor housing 10 from an upper end plate cover discharge hole 172T (refer to FIG. 1) provided in the upper end plate cover 170T.

Similarly, in the lower cylinder chamber 130S, the lower piston 125S fitted to the lower eccentric portion 152S of the rotation shaft 15 revolves along the outer circumferential surface (the inner circumferential surface of the lower cylinder 121S) of the lower cylinder chamber 130S due to the rotation of the rotation shaft 15. In the lower cylinder chamber 130S, in accordance with the revolution of the lower piston 125S, the lower inlet chamber 131S suctions the refrigerant from the lower inlet pipe 104 while enlarging the capacity, and the lower compression chamber 133S compresses the refrigerant while reducing the capacity. When the pressure of the compressed refrigerant becomes higher than the pressure of the lower end plate cover chamber 180S on the outside of the lower discharge valve 200S, the lower discharge valve 200S is open, and the refrigerant is discharged to the lower end plate cover chamber 180S from the lower compression chamber 133S. The refrigerant discharged to the lower end plate cover chamber 180S is discharged to the inside of the compressor housing 10 from the upper end plate cover discharge hole 172T (refer to FIG. 1) provided in the upper end plate cover 170T through the refrigerant path hole 136 and the upper end plate cover chamber 180T.

The refrigerant discharged to the inside of the compressor housing 10 is guided to the upper part of the motor 11 through a cutout (not illustrated) which is provided on the outer circumference of the stator 111, and communicates with the upper and lower parts, a void (not illustrated) of a winding portion of the stator 111, or a void 115 (refer to FIG. 1) between the stator 111 and the rotor 112, and is discharged from the discharge pipe 107 in the upper portion of the compressor housing 10.

Hereinafter, a flow of the lubricant oil 18 will be described. The lubricant oil 18 passes through the oil feeding vertical hole 155 and the plurality of oil feeding horizontal holes 156 from the lower end of the rotation shaft 15, and lubricates each sliding surface by supplying oil to a sliding surface between the sub-bearing unit 161S and the sub-shaft unit 151 of the rotation shaft 15, a sliding surface between the main bearing unit 161T and the main shaft unit 153 of the rotation shaft 15, a sliding surface between the lower eccentric portion 152S of the rotation shaft 15 and the lower piston 125S, and a sliding surface between the upper eccentric portion 152T and the upper piston 125T.

The oil feeding impeller 158 suctions up the lubricant oil 18 by applying a centrifugal force to the lubricant oil 18 in the oil feeding vertical hole 155, and in a case where the lubricant oil 18 is discharged from the inside of the compressor housing 10 together with the refrigerant, and an oil level is low, a role of supplying the lubricant oil 18 to the above-described sliding surface is also reliably achieved.

Figure 4:
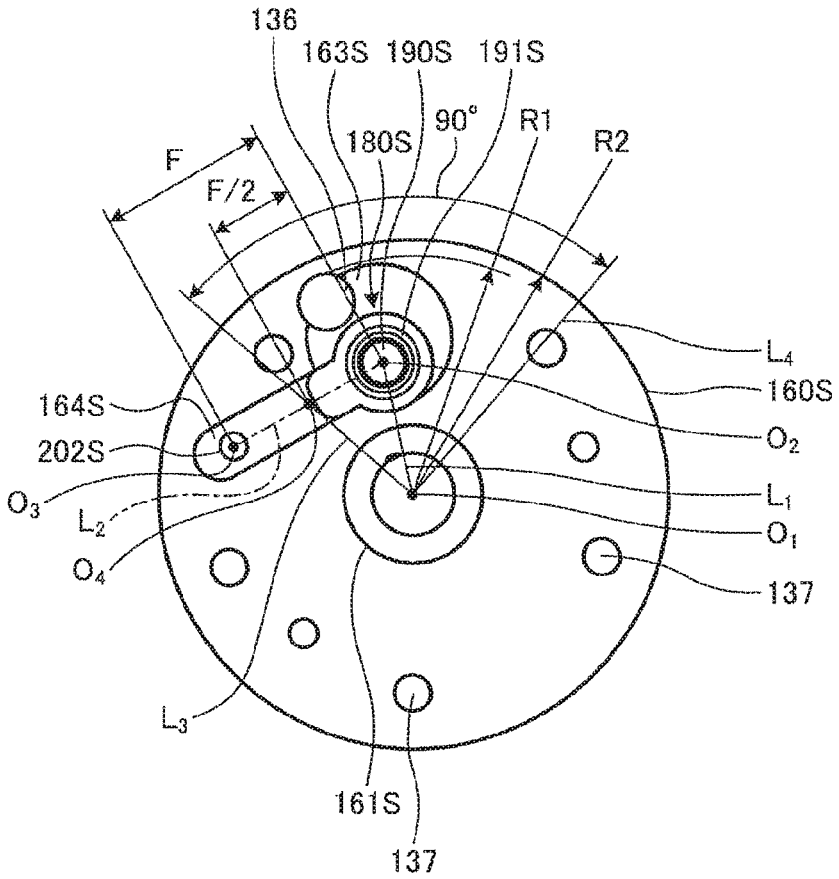
FIG. 4 is a plan view when a lower end plate of the rotary compressor according to the first embodiment is viewed from below.
Figure 5:
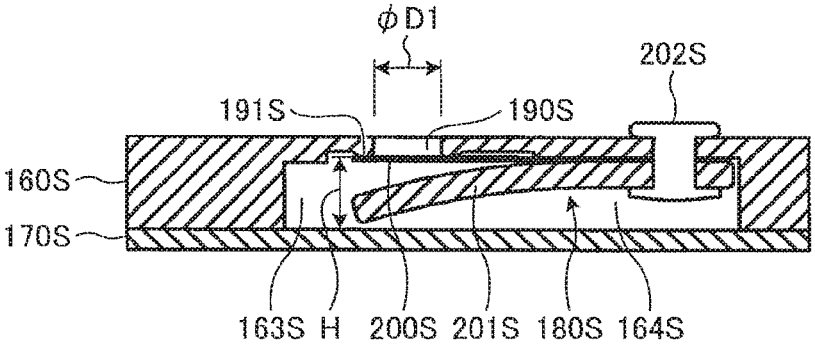
FIG. 5 is a longitudinal sectional view illustrating a lower discharge valve accommodation concave portion to which a lower discharge valve of the rotary compressor according to the first embodiment is attached.

Next, a characteristic configuration of the rotary compressor 1 according to the first embodiment will be described. FIG. 4 is a plan view when a lower end plate of the rotary compressor according to the first embodiment is viewed from below. FIG. 5 is a longitudinal sectional view illustrating a lower discharge valve accommodation concave portion to which a lower discharge valve of the rotary compressor according to the first embodiment is attached.

As illustrated in FIG. 4, in the lower end plate cover chamber 180S, the lower end plate cover 170S is formed in a shape of a flat plate, the bulging portion in which the hollow space is formed on the inside is not provided unlike the upper end plate cover 170T, and the lower end plate cover chamber 180S is configured of a lower discharge chamber concave portion 163S and the lower discharge valve accommodation concave portion 164S which are provided in the lower end plate 160S. The lower discharge valve accommodation concave portion 164S linearly extends in a shape of a groove in the direction orthogonal to a diameter L1 which links a center O1 of the sub-bearing unit 161S and a center O2 of the lower discharge hole 190S, that is, in the circumferential direction of the lower end plate 160S, from the position of the lower discharge hole 190S. The lower discharge valve accommodation concave portion 164S is linked to the lower discharge chamber concave portion 163S. The width of the lower discharge valve accommodation concave portion 164S is formed to be slightly greater than the widths of the lower discharge valve 200S and the lower discharge valve cap 201S. The lower discharge valve accommodation concave portion 164S accommodates the lower discharge valve 200S and the lower discharge valve cap 201S, and positions the lower discharge valve 200S and the lower discharge valve cap 201S.

The lower discharge chamber concave portion 163S is formed to have the same depth as the depth of the lower discharge valve accommodation concave portion 164S to overlap the lower discharge hole 190S side of the lower discharge valve accommodation concave portion 164S. The lower discharge hole 190S side of the lower discharge valve accommodation concave portion 164S is accommodated in the lower discharge chamber concave portion 163S.

The lower discharge chamber concave portion 163S is formed within a fan-like range between a diameter L3 which passes through the center O1 of the sub-bearing portion 161S, and a center O4 of a line segment L2 (length F) which links the center O2 of the lower discharge hole 190S and a center O3 of the lower rivet 202S, and a diameter L4 which is open by 900 of a pitch angle in the direction of the lower discharge hole 190S considering the center O1 of the sub-bearing unit 161S as a center. At least a part of the refrigerant path hole 136 overlaps the lower discharge chamber concave portion 163S, and the refrigerant path hole 136 is disposed at a position which communicates with the lower discharge chamber concave portion 163S.

As illustrated in FIG. 5, in a circumferential edge of an opening portion of the lower discharge hole 190S, the annular lower valve seat 191S is formed to be elevated to a bottom portion of the lower discharge chamber concave portion 163S, and the lower valve seat 191S abuts against a front portion of the lower discharge valve 200S. A depth H to the lower valve seat 191S of the lower discharge chamber concave portion 163S is equal to or less than 1.5 times a diameter ϕD1 of the lower discharge hole 190S.

It is necessary to set an opening degree of the lower discharge valve 200S when the refrigerant is discharged from the lower discharge hole 190S, that is, a lift amount of the lower discharge valve 200S with respect to the lower valve seat 191S, to be a lift amount that does not become resistance of a discharge flow. Therefore, it is necessary to determine the depth H to the lower valve seat 191S of the lower discharge chamber concave portion 163S considering the lift amount of the lower discharge valve 200S and the thickness of the lower discharge valve 200S and the lower discharge valve cap 201S, but 1.5 times the diameter D1 of the lower discharge hole 190S is sufficient.

The refrigerant path hole 136 is disposed at a position at which at least a part thereof overlaps an upper discharge chamber concave portion 163T, and communicates with the upper discharge chamber concave portion 163T. Specific description of the upper discharge chamber concave portion 163T and the upper discharge valve accommodation concave portion 164T which are formed in the upper end plate 160T, will be omitted, but the shapes thereof are formed to be shapes similar to those of the lower discharge chamber concave portion 163S and the lower discharge valve accommodation concave portion 164S which are formed in the lower end plate 160S. The upper end plate cover chamber 180T is configured of the bulging portion in which the hollow space is formed on the inside of the upper end plate cover 170T, the upper discharge chamber concave portion 163T, and the upper discharge valve accommodation concave portion 164T.

According to the configuration of the rotary compressor 1 according to the above-described first embodiment, it is possible to shorten the distance between the lower discharge hole 190S and an inlet of the refrigerant path hole 136. Accordingly, the capacity of the lower end plate cover chamber 180S, that is, the capacity which is a sum of the capacity of the lower discharge chamber concave portion 163S and the capacity of the lower discharge valve accommodation concave portion 164S, can be substantially reduced compared to that in the related art. Accordingly, when the refrigerant is compressed in the upper cylinder 121T and is discharged from the upper discharge hole 190T, a flow amount of the refrigerant which flows backward through the refrigerant path hole 136, and flows into the lower end plate cover chamber 180S can be reduced, and it is possible to suppress deterioration of efficiency of the rotary compressor 1.

Second Embodiment

Figure 6:
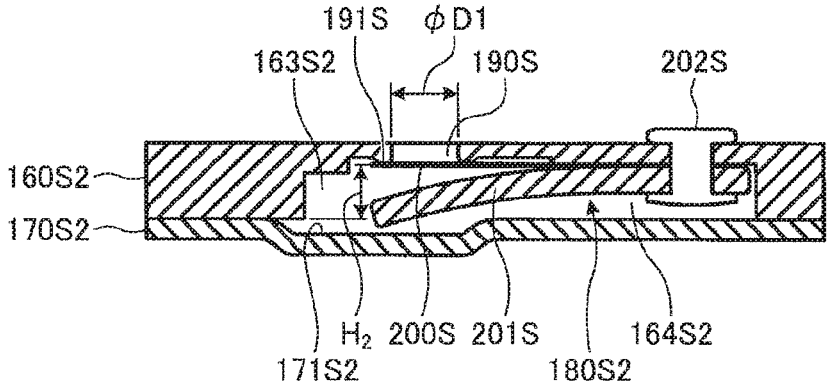
FIG. 6 is a longitudinal sectional view illustrating a lower discharge valve accommodation concave portion to which a lower discharge valve of a rotary compressor according to a second embodiment is attached.

FIG. 6 is a longitudinal sectional view illustrating a lower discharge valve accommodation concave portion to which a lower discharge valve of a rotary compressor according to a second embodiment is attached. As illustrated in FIG. 6, in the rotary compressor 1 according to the second embodiment, a depth H2 to the lower valve seat 191S of a lower discharge chamber concave portion 163S2 and a lower discharge valve accommodation concave portion 164S2 which are formed in a lower end plate 160S2, is more shallow than the depth H to the lower valve seat 191S of the lower discharge chamber concave portion 163S and the lower discharge valve accommodation concave portion 164S which are formed in the lower end plate 160S of the rotary compressor 1 according to the first embodiment. A lower end plate cover 170S2 has a concave portion 171S2 which is at a part that opposes the front portion of the lower discharge valve cap 201S, and accommodates a part at which the front portion of the lower discharge valve cap 201S protrudes from the lower discharge chamber concave portion 163S2. The depth to the lower valve seat 191S from the concave portion 171S2 is formed to be equal to or less than 1.5 times the diameter ϕD1 of the lower discharge hole 190S.

According to the configuration of the rotary compressor 1 according to the above-described second embodiment, it is possible to reduce the capacity of the lower discharge valve accommodation concave portion 164S2 to be smaller than that of the rotary compressor 1 according to the first embodiment. Accordingly, when the refrigerant is compressed in the upper cylinder 121T and is discharged from the upper discharge hole 190T, a flow amount of the refrigerant which flows backward through the refrigerant path hole 136, and flows into a lower end plate cover chamber 180S2 can further be reduced. As a result, it is possible to suppress deterioration of efficiency of the rotary compressor 1.

Third Embodiment

Figure 7:
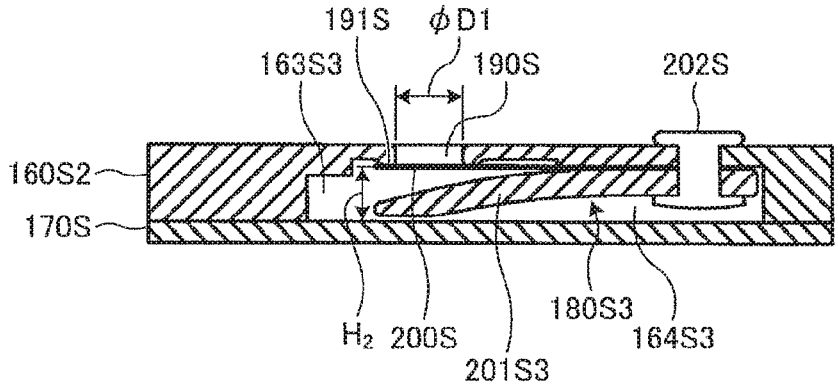
FIG. 7 is a longitudinal sectional view illustrating a lower discharge valve accommodation concave portion to which a lower discharge valve of a rotary compressor according to a third embodiment is attached.

FIG. 7 is a longitudinal sectional view illustrating a lower discharge valve accommodation concave portion to which a lower discharge valve of a rotary compressor according to a third embodiment is attached. As illustrated in FIG. 7, in the rotary compressor 1 according to the third embodiment, in the front portion of a lower discharge valve cap 201S3, a part which is close to the lower end plate cover 170S is formed to be thinner than the other parts. Accordingly, while ensuring the same opening degree of the lower discharge valve 200S of the rotary compressor 1 according to the first embodiment, the depth H2 to the lower valve seat 191S of a lower discharge chamber concave portion 163S3 and a lower discharge valve accommodation concave portion 164S3 is shallow similar to that of the second embodiment.

According to the configuration of the rotary compressor 1 according to above-described the third embodiment, it is possible to reduce the capacity of a lower end plate cover chamber 180S3 to be smaller than that of the rotary compressor 1 according to the second embodiment only by the capacity of the concave portion 171S2 of the second embodiment. Accordingly, when the refrigerant which is compressed in the upper cylinder 121T and is discharged from the upper discharge hole 190T, the flow amount of the refrigerant which flows backward through the refrigerant path hole 136, and flows into the lower end plate cover chamber 180S3 can further be reduced.

As a result, it is possible to suppress deterioration of efficiency of the rotary compressor 1.

Fourth Embodiment

Figure 8:
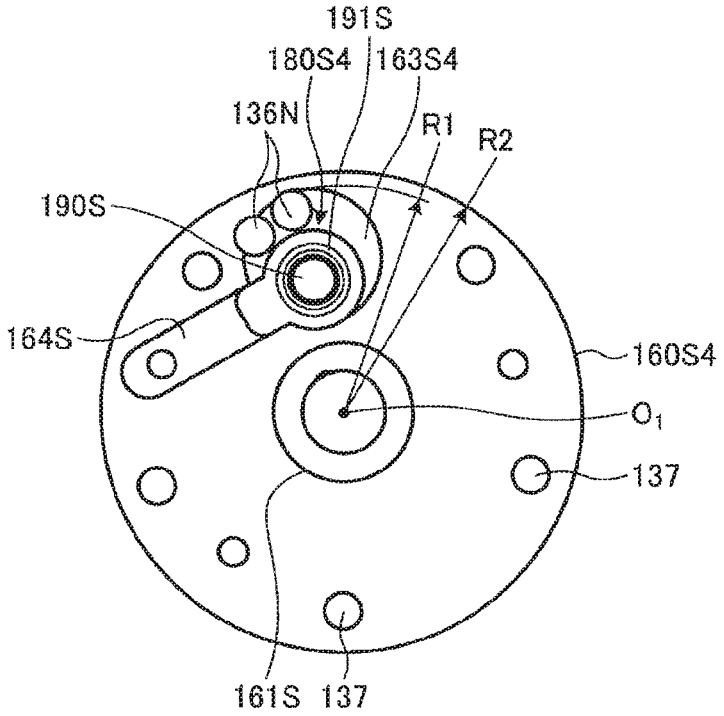
FIG. 8 is a plan view when a lower end plate of a rotary compressor according to a fourth embodiment is viewed from below.

FIG. 8 is a plan view when a lower end plate of a rotary compressor according to a fourth embodiment is viewed from below. As illustrated in FIG. 8, in the rotary compressor 1 according to the fourth embodiment, the diameter of a refrigerant path hole 136N provided in a lower end plate 160S4 (and the lower cylinder 121S, the intermediate partition plate 140, the upper cylinder 121T, and the upper end plate 160T), is smaller than that of the refrigerant path hole 136 of the rotary compressor 1 according to the first embodiment, and two refrigerant path holes 136N are provided (three or more refrigerant path holes 136N may be provided). A total area of openings of the two (three or more) refrigerant path holes 136N is equivalent to an opening area of the refrigerant path hole 136 of the rotary compressor 1 according to the first embodiment. Accordingly, a radius R1 to the outmost circumference of the refrigerant path hole 136N from the center O1 of the sub-bearing unit 161S can be smaller than a radius R1 to the outmost circumference of the refrigerant path hole 136 from the center O1 of the sub-bearing unit 161S of the rotary compressor 1 (refer to FIG. 4) according to the first embodiment, and the diameter of a round lower discharge chamber concave portion 163S4 can be reduced.

According to the configuration of the rotary compressor 1 according to the above-described fourth embodiment, it is possible to reduce a bottom area of the lower discharge chamber accommodation concave portion 163S4 to be smaller than a bottom area of the lower discharge chamber concave portion 163S of the rotary compressor 1 according to the first embodiment, and to reduce the capacity of the lower discharge chamber concave portion 163S4. Accordingly, when the refrigerant which is compressed in the upper cylinder 121T and is discharged from the upper discharge hole 190T, the flow amount of the refrigerant which flows backward through the refrigerant path hole 136N, and flows into a lower end plate cover chamber 180S4 can further be reduced. As a result, it is possible to suppress deterioration of efficiency of the rotary compressor 1.

In addition, the radius R1 to the outmost circumference of the refrigerant path hole 136N from the center O1 of the sub-bearing portion 161S can further be reduced to be smaller than the radius R1 to the outmost circumference of the refrigerant path hole 136 from the center O1 of the sub-bearing unit 161S of the rotary compressor 1 (refer to FIG. 4) according to the first embodiment. Therefore, a radius R2 of the lower end plate 160S4 (and the lower cylinder 121S, the intermediate partition plate 140, the upper cylinder 121T, and the upper end plate 160T) can be reduced to be smaller than a radius R2 (refer to FIG. 4) of the lower end plate 160S (and the lower cylinder 121S, the intermediate partition plate 140, the upper cylinder 121T, and the upper end plate 160T) of the first embodiment. As a result, an effect of reducing material costs of the compressing unit 12 is also achieved.

Fifth Embodiment

Figure 9:
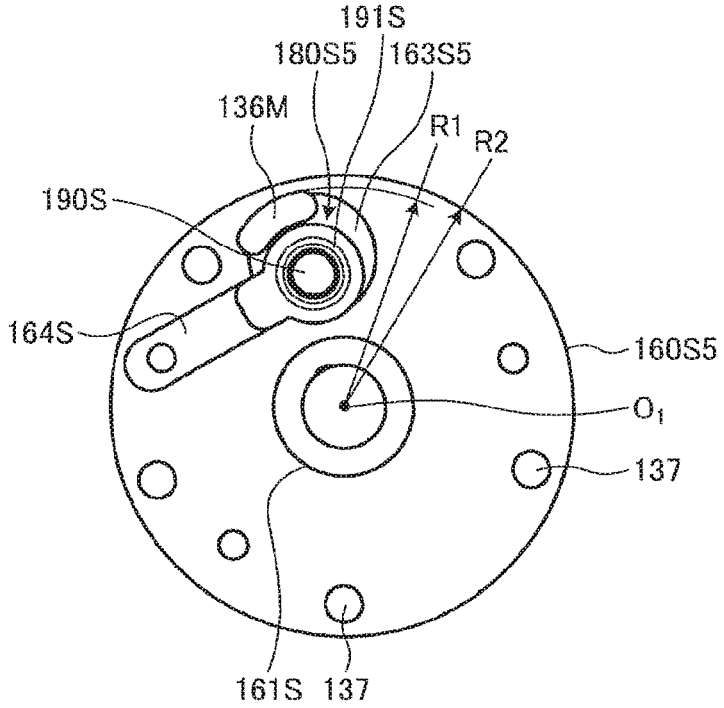
FIG. 9 is a plan view when a lower end plate of a rotary compressor according to a fifth embodiment is viewed from below.

FIG. 9 is a plan view when a lower end plate of a rotary compressor according to a fifth embodiment is viewed from below. As illustrated in FIG. 9, in the rotary compressor 1 according to the fifth embodiment, a refrigerant path hole 136M provided in a lower end plate 160S5 (and the lower cylinder 121S, the intermediate partition plate 140, the upper cylinder 121T, and the upper end plate 160T), is a long hole of which the width is smaller than the diameter of the refrigerant path hole 136N of the rotary compressor 1 according to the fourth embodiment, and an opening area thereof is equal to that of the refrigerant path hole 136N. The refrigerant path hole (long hole) 136M is formed to be along the circumferential direction of the lower valve seat 191S. Accordingly, a radius R1 to the outmost circumference of the refrigerant path hole 136M from the center O1 of the sub-bearing unit 161S can be smaller than the radius R1 to the outmost circumference of the refrigerant path hole 136N from the center O1 of the sub-bearing unit 161S of the rotary compressor 1 (refer to FIG. 8) according to the fourth embodiment, and the diameter of a round lower discharge chamber concave portion 163S5 can be reduced.

According to the configuration of the rotary compressor 1 according to the above-described fifth embodiment, it is possible to further reduce a bottom area of the lower discharge chamber concave portion 163S5 to be smaller than a bottom area of the lower discharge chamber concave portion 163S4 of the rotary compressor 1 according to the fourth embodiment, and to reduce the capacity of the lower discharge chamber concave portion 163S5. Accordingly, when the refrigerant which is compressed in the upper cylinder 121T and is discharged from the upper discharge hole 190T, the flow amount of the refrigerant which flows backward through the refrigerant path hole 136M, and flows into a lower end plate cover chamber 180S5 can further be reduced. As a result, it is possible to suppress deterioration of efficiency of the rotary compressor 1.

In addition, the radius R1 to the outmost circumference of the refrigerant path hole 136M from the center O1 of the sub-bearing unit 161S can further be reduced to be smaller than the radius R1 to the outmost circumference of the refrigerant path hole 136N from the center O1 of the sub-bearing portion 161S of the rotary compressor 1 (refer to FIG. 8) according to the fourth embodiment. Therefore, the radius R2 of the lower end plate 160S5 (and the lower cylinder 121S, the intermediate partition plate 140, the upper cylinder 121T, and the upper end plate 160T) can be reduced to be smaller than the radius R2 (refer to FIG. 8) of the lower end plate 160S4 (and the lower cylinder 121S, the intermediate partition plate 140, the upper cylinder 121T, and the upper end plate 160T) of the fourth embodiment. As a result, an effect of further reducing material costs of the compressing unit 12 is also achieved.

Sixth Embodiment

Figure 10:
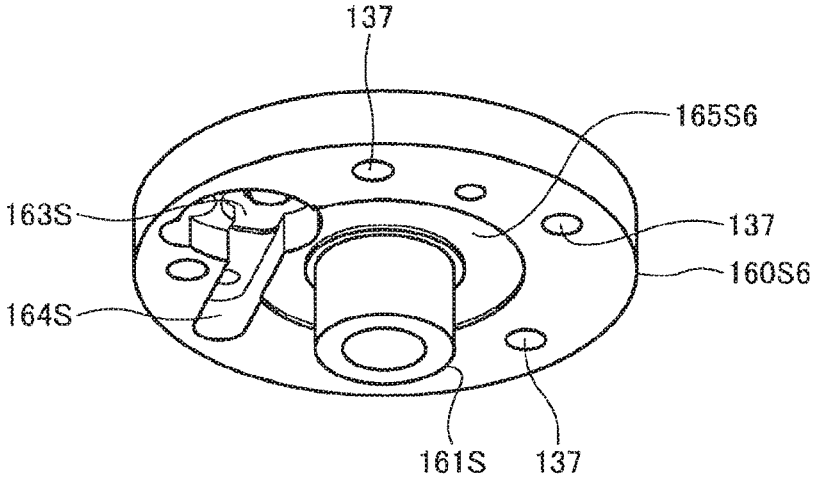
FIG. 10 is a perspective view when a lower end plate of a rotary compressor according to a sixth embodiment is viewed from below.

FIG. 10 is a perspective view when a lower end plate of a rotary compressor according to a sixth embodiment is viewed from below. As illustrated in FIG. 10, in the rotary compressor 1 according to the sixth embodiment, in a region other than a region in which the lower discharge chamber concave portion 163S and the lower discharge valve accommodation concave portion 164S on a lower surface (which becomes an abutting surface with the lower end plate cover 170S of the first embodiment) of a lower end plate 160S6 are formed, on an inner side of a plurality of bolt holes 137, a refrigerant introduction portion 165S6 which is an annular groove of which the depth that surrounds the sub-bearing unit 161S is equal to or less than 1 mm, is formed. In addition, the annular groove which becomes the refrigerant introduction portion 165S6 may be formed on the upper surface of the lower end plate cover 170S that opposes the lower end plate 160S6 instead of the lower surface of the lower end plate 160S6.

One end of the refrigerant introduction portion 165S6 communicates with the lower discharge chamber concave portion 163S, and the other end communicates with the lower discharge valve accommodation concave portion 164S (the refrigerant introduction portion 165S6 may communicate only with any one of the lower discharge chamber concave portion 163S and the lower discharge valve accommodation concave portion 164S). As the refrigerant introduction portion 165S6 communicates with the lower discharge chamber concave portion 163S or the lower discharge valve accommodation concave portion 164S, the high-temperature high-pressure refrigerant which is discharged from the lower discharge hole 190S is guided to the refrigerant introduction portion 165S6 through the lower discharge chamber concave portion 163S or the lower discharge valve accommodation concave portion 164S.

As the high-temperature high-pressure refrigerant is guided to the refrigerant introduction portion 165S6, the lower end plate cover 170S is heated, and when the air conditioner is started to be operated from a state of being stopped for a long period of time, a liquid refrigerant 19 (refer to FIG. 1) which remains in the lower portion of the compressor housing 10 of the rotary compressor 1 is heated, and is gasified as quickly as possible, and it is possible to suppress damage of the sliding portion of the compressing unit 12 by suctioning up the liquid refrigerant 19 instead of the lubricant oil 18 for a long period of time. In order to decrease an amount by which the refrigerant compressed in the upper cylinder 121T flows backward through the refrigerant path hole 136, it is desirable that the capacity of the space of the refrigerant introduction portion 165S6 is small in a range in which it is possible to ensure a necessary heating amount for gasifying the liquid refrigerant 19. Therefore, the depth of the refrigerant introduction portion 165S6 becomes more shallow in a range in which it is possible to ensure a necessary heating amount for gasifying the liquid refrigerant 19.

Seventh Embodiment

Figure 11:
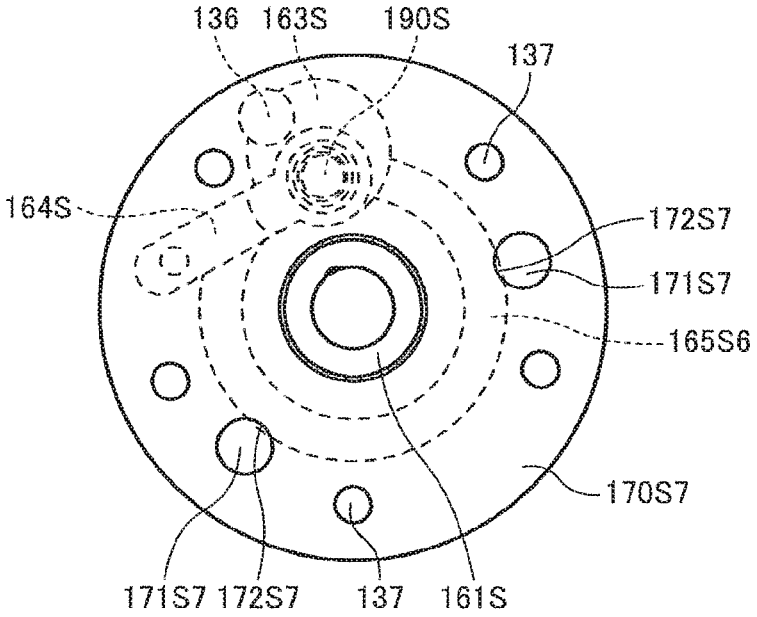
FIG. 11 is a transparent plan view when a state where a lower end plate of a rotary compressor according to a seventh embodiment and a lower end plate cover overlap each other is viewed from below.

FIG. 11 is a transparent plan view illustrating a state where a lower end plate of a rotary compressor according to a seventh embodiment and a lower end plate cover overlap each other. As illustrated in FIG. 11, in the rotary compressor 1 according to the seventh embodiment, in a flat plate-like lower end plate cover 170S7, two round auxiliary bolt escaping holes 171S7 for avoiding abutting of a head portion of the auxiliary bolt 176 (refer to FIG. 2) which fastens the lower end plate 160S6 of the sixth embodiment and the lower cylinder 121S to each other, to the lower end plate cover 170S7, are provided. A part of the auxiliary bolt escaping hole 171S7 overlaps and communicates with the refrigerant introduction portion 165S6 formed in the lower end plate 160S6, and becomes a refrigerant discharging portion 172S7. In addition, in a case where the auxiliary bolt escaping hole 171S7 does not overlap the refrigerant introduction portion 165S6, in the lower end plate cover 170S7 (170S, 170S2) a small hole (not illustrated) which communicates with the lower discharge chamber concave portion 163S, the lower discharge valve accommodation concave portion 164S, or the refrigerant introduction portion 165S6, is additionally provided, and the small hole may be the refrigerant discharging portion 172S7.

The refrigerant discharging portion 172S7 does not pass through the refrigerant path hole 136, and directly discharges the compressed refrigerant to the inside of the compressor housing 10. By the refrigerant discharging portion 172S7, it is possible to suppress deterioration of efficiency or generation of noise caused by that the lubricant oil 18 remains in the lower discharge chamber concave portion 163S and the lower discharge valve accommodation concave portion 164S of the lower end plate 160S6, the lower discharge hole 190S is immersed in the lubricant oil 18. In addition, by providing the refrigerant discharging portion 172S7, the refrigerant discharged from the refrigerant discharging portion 172S7 heats the liquid refrigerant 19 (refer to FIG. 1) that remains in the lower portion of the compressor housing 10 in a state of being stopped for a long period of time, and an effect of prompting gasification is also achieved.

Eighth Embodiment

Figure 12:
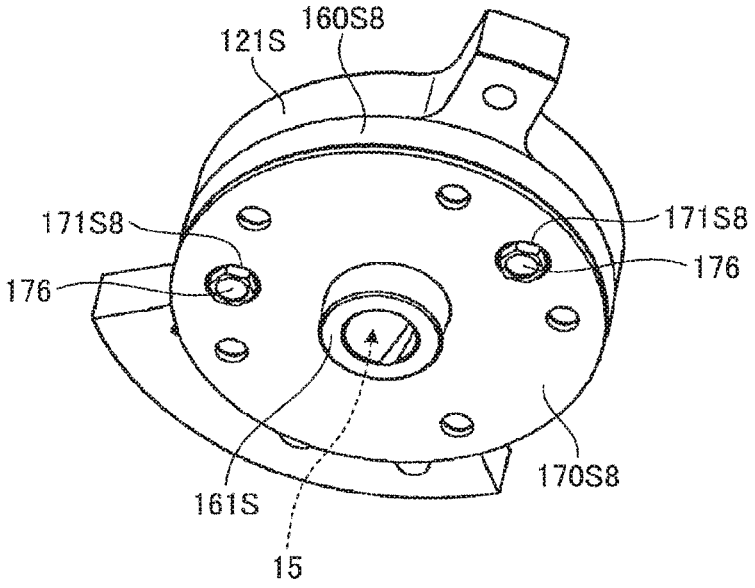
FIG. 12 is a perspective view when a lower end plate of a rotary compressor according to an eighth embodiment and a lower end plate cover are viewed from below.
Figure 13:
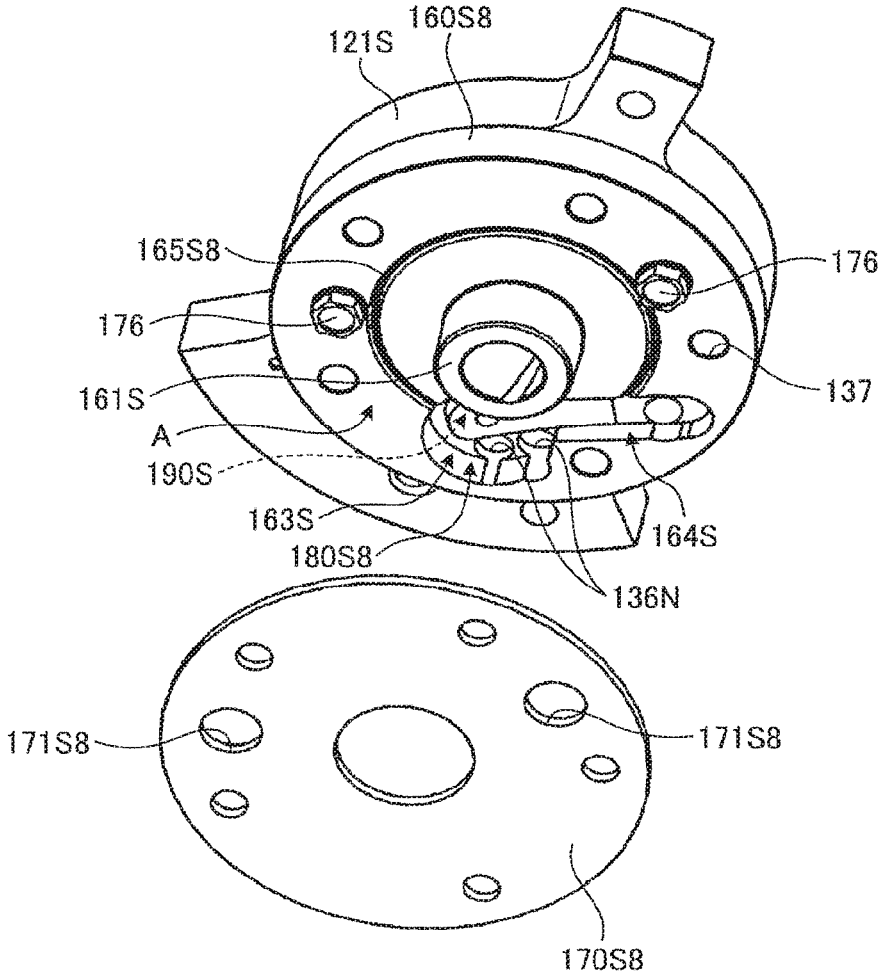
FIG. 13 is an exploded perspective view when the lower end plate of the rotary compressor according to the eighth embodiment and the lower end plate cover are viewed from below.
Figure 14:
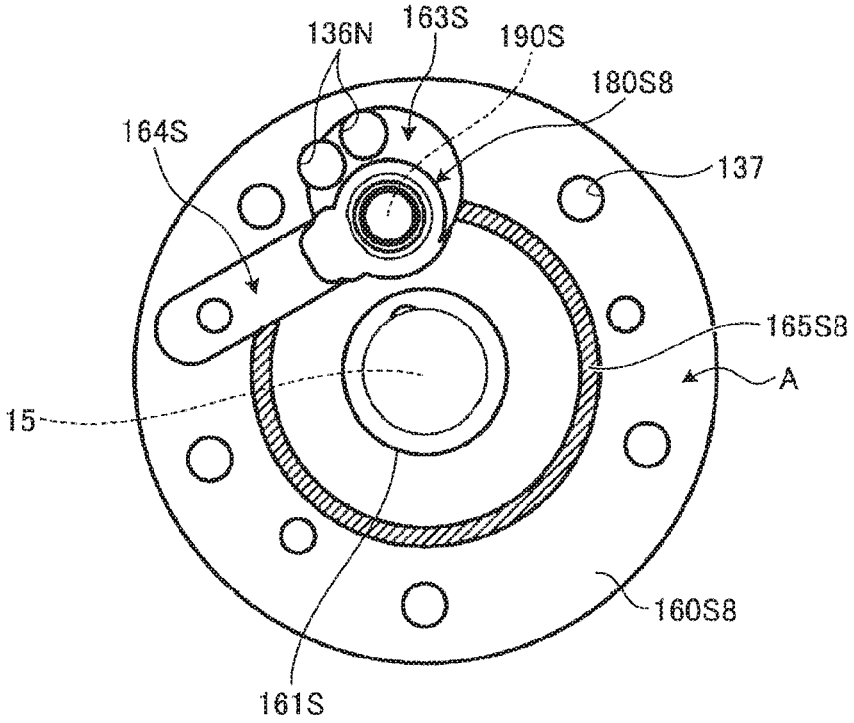
FIG. 14 is a plan view when the lower end plate of the rotary compressor according to the eighth embodiment is viewed from below.
Figure 15:
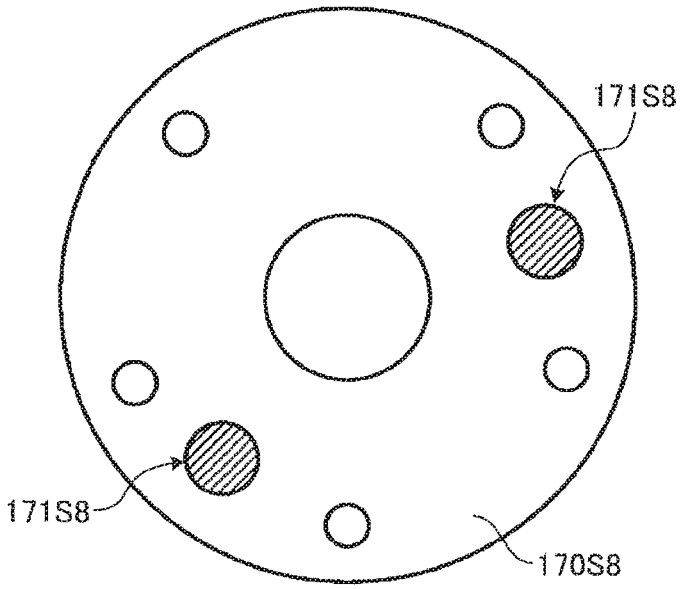
FIG. 15 is a plan view when a lower end plate cover of the rotary compressor according to the eighth embodiment is viewed from below.

FIG. 12 is a perspective view when a lower end plate of a rotary compressor according to an eighth embodiment and a lower end plate cover are viewed from below. FIG. 13 is an exploded perspective view when the lower end plate of the rotary compressor according to the eighth embodiment and the lower end plate cover are viewed from below. FIG. 14 is a plan view when the lower end plate of the rotary compressor according to the eighth embodiment is viewed from below. FIG. 15 is a plan view when a lower end plate cover of the rotary compressor according to the eighth embodiment is viewed from below.

As illustrated in FIGS. 12 and 13, the rotary compressor according to the eighth embodiment includes a lower end plate 160S8 which closes the lower side of the lower cylinder 121S, and a lower end plate cover 170S8 which covers the lower end plate 160S8, and forms a lower end plate cover chamber 180S8 between the lower end plate 160S8 and the lower end plate cover 170S8. In addition, as illustrated in FIGS. 13 and 14, the rotary compressor according to the eighth embodiment includes the lower discharge hole 190S which is provided in the lower end plate 160S8 and communicates with the lower compression chamber 133S and the lower end plate cover chamber 180S8, and the refrigerant path hole 136N which penetrates the lower end plate 160S8, the lower cylinder 121S, the intermediate partition plate 140, the upper end plate 160T, and the upper cylinder 121T, and communicates with the lower end plate cover chamber 180S8 and the upper end plate cover chamber 180T. Other configuration elements in the eighth embodiment are similar to those of the first embodiment and the fourth embodiment, and are given the same reference numerals as those of the first embodiment and the fourth embodiment, and the description thereof is omitted.

As illustrated in FIGS. 13 and 14, on a mating surface A between the lower end plate 160S8 and the lower end plate cover 170S8, a communication groove 165S8 which communicates with the lower end plate cover chamber 180S8 is provided along the mating surface A. In the eighth embodiment, on the mating surface A on the lower end plate 160S8 side, the C-like communication groove 165S8 in which the lower end plate cover chamber 180S8 and both ends communicate with each other, is provided. The communication groove 165S8 has a function of discharging the refrigerant and the lubricant oil 18 which remain in the lower end plate cover chamber 180S8 to the inside of the compressor housing 10 in addition to the function of the refrigerant introduction portion 165S6 in the sixth embodiment and the seventh embodiment.

In addition, the communication groove 165S8 is formed, for example, so that a sectional shape is a V-like V groove. The communication groove 16588 is not limited to the V groove, and may be a groove which has another sectional shape, such as an angular groove.

As illustrated in FIGS. 13 and 15, the lower end plate cover 170S8 is formed in a shape of a flat plate. In the lower end plate cover 170S8, two round auxiliary bolt escaping holes 171S8 for avoiding abutting of the head portion of the auxiliary bolt 176 (refer to FIG. 2) which fastens the lower end plate 160S8 of the eighth embodiment and the lower cylinder 121S to each other, to the lower end plate cover 170S8, are provided. The auxiliary bolt escaping hole 171S8 is provided as a through hole which passes in the thickness direction (the direction of the rotation shaft 15) of the lower end plate cover 170S8. On a plane orthogonal to the rotation shaft 15, a part of the auxiliary bolt escaping hole 171S8 overlaps and communicates with the communication groove 165S8 formed in the lower end plate 160S8 (refer to FIG. 16), and accordingly, configures a discharge portion 172S8 which discharges the refrigerant and the lubricant oil 18 from the lower end plate cover chamber 180S8. Therefore, the auxiliary bolt 176 is inserted into the auxiliary bolt escaping hole 171S8 which serves as a through hole, and the refrigerant and the lubricant oil 18 which pass through the discharge portion 172S8 are discharged to the inside of the compressor housing 10 from between the head portion of the auxiliary bolt 176 and the inner circumferential surface of the auxiliary bolt escaping hole 171S8.

By also using the auxiliary bolt escaping hole 171S8 as a through hole that configures a discharge portion 172S8, it is not necessary to form a through hole in addition to the auxiliary bolt escaping hole 171S8. As a result, it is possible to improve productivity of the rotary compressor. In addition, in a case where the auxiliary bolt escaping hole 171S8 does not overlap the communication groove 165S8, by additionally providing the through hole (not illustrated) which communicates with the communication groove 165S8 in the lower end plate cover 170S8, the discharge portion 172S8 may be configured of the through hole.

Figure 16:
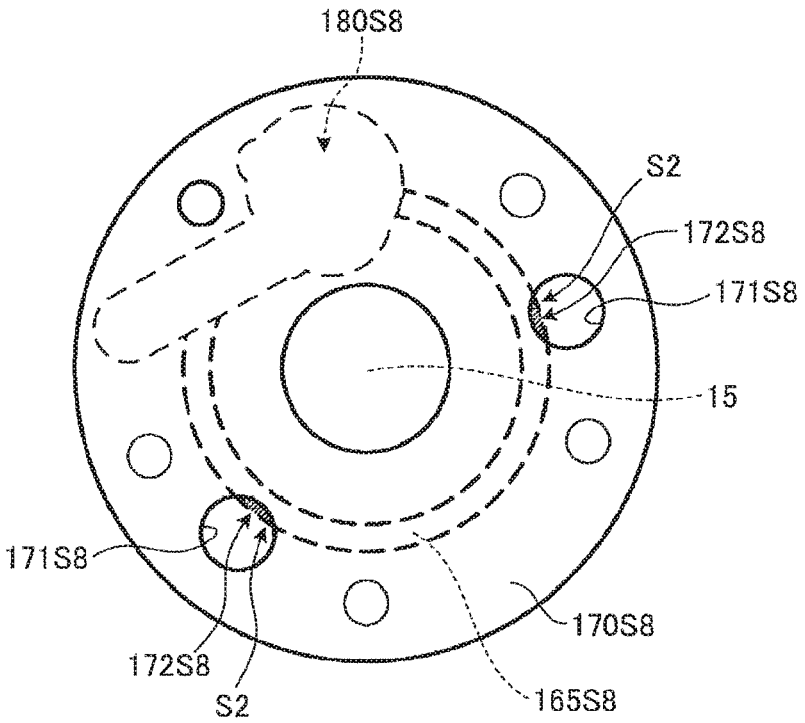
FIG. 16 is a transparent plan view when a state where the lower end plate of the rotary compressor according to the eighth embodiment and the lower end plate cover overlap each other is viewed from below.
Figure 17:
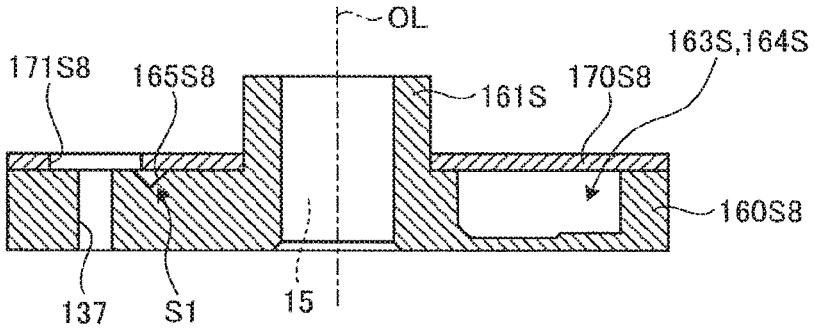
FIG. 17 is a longitudinal sectional view illustrating a state where the lower end plate of the rotary compressor according to the eighth embodiment and the lower end plate cover overlap each other.

FIG. 16 is a transparent plan view illustrating a state where the lower end plate 160S8 of the rotary compressor according to the eighth embodiment and the lower end plate cover 170S8 overlap each other and which is viewed from below. FIG. 17 is a longitudinal sectional view illustrating a state where the lower end plate 160S8 of the rotary compressor according to the eighth embodiment and the lower end plate cover 170S8 overlap each other. When a sectional area of the communication groove 165S8 which passes through a center line OL (a center line OL of the sub-bearing unit 161S) of the rotation shaft 15, and is on a section along the direction of the rotation shaft 15 is S1 [$mm^2$] (refer to FIG. 17), an area of the discharge portion 172S8 by which the auxiliary bolt escaping hole 171S8 (through hole) and the communication groove 165S8 overlap each other on a plane orthogonal to the rotation shaft 15 is S2 [$mm^2$](refer to FIG. 16), and an excluding capacity of the lower cylinder chamber 130S is V [cc], each of $0.10 \leq (S2/V) \leq 0.50$ (Expression 1), and $1.0 \leq (S2/S1) \leq 7.0$ (Expression 2) is satisfied.

$$0.10 \leq (S2/V) \leq 0.50 \quad \text{(Expression 1)}$$

$$1.05(S2/S1) \leq 7.0 \quad \text{(Expression 2)}$$

A case where (S2/V) is less than 0.10 [$mm^2$/cc] and a case where (S2/S1) is less than 1.0 [$mm^2$/cc], are not preferable since it is not possible to sufficiently discharge the lubricant oil 18 that remains in the lower end plate cover chamber 180S8 to the inside of the compressor housing 10 via the communication groove 165S8 and the discharge portion 172S8 (auxiliary bolt escaping hole 171S8), the lubricant oil 18 remains in the lower end plate cover chamber 180S8, and accordingly, noise of a region of 400 [Hz] to 800 [Hz] becomes large. Meanwhile, a case where (S2/V) exceeds 0.50 [$mm^2$/cc] and a case where (S2/S1) exceeds 7.0 [$mm^2$/cc], are not preferable since a discharge amount by which the refrigerant from the lower end plate cover chamber 180S8 is discharged to the inside of the compressor housing 10 via the communication groove 165S8 and the discharge portion 172S8 (through hole) becomes large, and accordingly, noise of a region of 630 [Hz] to 1250 [Hz] becomes large. In other words, in (S2/V) and (S2/S1), a range for appropriately discharging the refrigerant and the lubricant oil 18 in the lower end plate cover chamber 180S8 to the inside of the compressor housing 10 is present, and the range becomes a range which satisfies the expressions 1 and 2.

As described above, in the rotary compressor according to the eighth embodiment, when a sectional area of the communication groove 165S8 is S1 [$mm^2$], an area of the discharge portion 172S8 in which the auxiliary bolt escaping hole 171S8 and the communication groove 165S8 overlap each other is S2 [$mm^2$], and an excluding capacity of the lower cylinder chamber 130S is V [cc], each of $0.10 \leq (S2/V) \leq 0.50$ (Expression 1) and $1.0 \leq (S2/S1) \leq 7.0$ (Expression 2) is satisfied. Accordingly, it becomes possible to appropriately discharge the refrigerant and the lubricant oil 18 which remain in the lower end plate cover chamber 180S8 to the inside of the compressor housing 10, and it is possible to suppress noise which is generated when the refrigerant and the lubricant oil 18 are discharged. In addition, in the eighth embodiment, similar to the first to the seventh embodiments, it is also possible to suppress a backflow of the refrigerant compressed in the upper cylinder 121T through the refrigerant path hole 136N, and to suppress deterioration of efficiency of the rotary compressor.

First Modification Example of Eighth Embodiment

Figure 18:
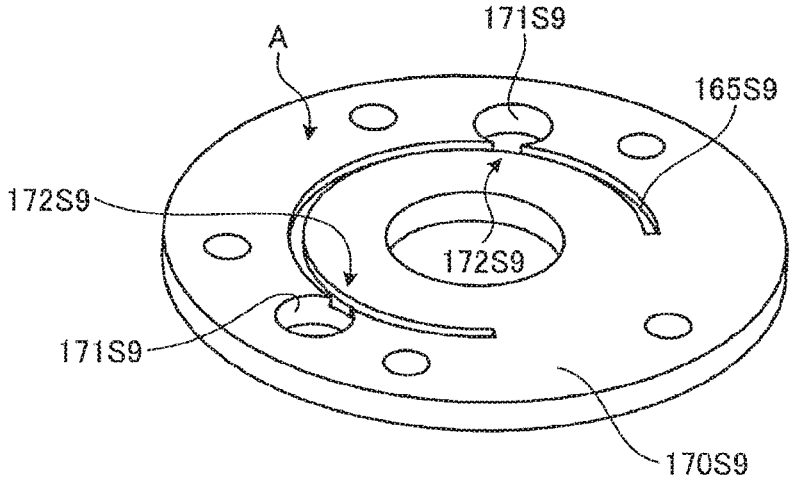
FIG. 18 is a perspective view when a lower end plate cover in a first modification example of the eighth embodiment is viewed from above.

FIG. 18 is a perspective view when a lower end plate cover in a first modification example of the eighth embodiment is viewed from above. In the eighth embodiment, the communication groove 165S8 is provided on the mating surface A on the lower end plate 160S8 side. In addition, as illustrated in FIG. 18, a communication groove 165S9 may be provided on the mating surface A on a lower end plate cover 170S9 side of the modification example. The communication groove 165S9 of the lower end plate cover 170S9 is formed in a C shape similar to the above-described communication groove 165S8, and both ends of the communication groove 165S9 respectively communicate with the lower end plate cover chamber 180S8. In addition, as the communication groove 165S9 overlaps and communicates with a part of two auxiliary bolt escaping holes 171S9 which are formed in the lower end plate cover 170S9, a discharge portion 172S9 which discharges the refrigerant and the lubricant oil 18 from the lower end plate cover chamber 180S8 is configured. In the modification example, similar to the eighth embodiment, it is possible to suppress noise which is generated when the refrigerant and the lubricant oil 18 are discharged from the inside of the lower end plate cover chamber 180S8.

In addition, the lower end plate cover 170S9 is a casting (casted component), and when performing the cutting processing for removing a casted surface of the lower end plate cover 170S9, it is possible to easily form the V groove-like communication groove 165S9 by using the cutting tool. Therefore, in a case where the lower end plate cover 170S9 is a casting, by forming the communication groove 165S9 as a V groove, it becomes possible to avoid additional adding of the number of forming processes of the communication groove 165S9.

In addition, although not illustrated, in both of the mating surfaces A of the lower end plate 160S8 and the lower end plate cover 170S8, the combined communication grooves may be respectively formed. In this case, it is possible to make the depth of each of the communication grooves which are respectively formed in the lower end plate 160S8 and the lower end plate cover 170S8 shallow.

In addition, in the above-described eighth embodiment and the first modification example, both ends of the communication groove 165S8 (165S9) are formed in a C shape which respectively communicates with the lower end plate cover chamber 180S8, but the shape of the communication groove on the plane orthogonal to the rotation shaft 15 is not limited thereto. The communication groove may have a shape in which one end communicates with the lower end plate cover chamber 180S8, and the other end communicates with the discharge portion (through hole) 172S8 (172S9), and for example, the communication groove may be formed in a linear shape.

Second Modification Example of Eighth Embodiment

Figure 19:
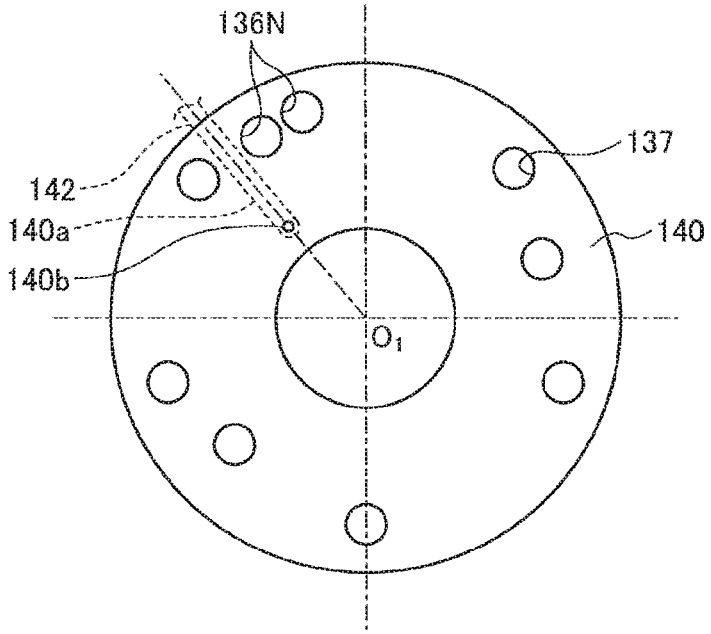
FIG. 19 is a plan view illustrating an injection hole of an intermediate partition plate in a second modification example of the eighth embodiment.

FIG. 19 is a plan view illustrating an injection hole of an intermediate partition plate in a second modification example of the eighth embodiment. As illustrated in FIG. 19, in the intermediate partition plate 140, a connection hole 140*a* is formed along the radial direction of the intermediate partition plate 140, and an injection pipe 142 for injecting the liquid refrigerant 19 to the inside of the upper compression chamber 133T and the inside of the lower compression chamber 133S is fitted to the connection hole 140*a*. In addition, injection holes 140*b* which communicate with the connection hole 140*a* and penetrate the intermediate partition plate 140 in the thickness direction (the direction of the rotation shaft 15) are provided respectively on both upper and lower surfaces of the intermediate partition plate 140.

One end portion of the injection pipe 142 is disposed on the outer circumferential surface of the compressor housing 10, and is connected to the injection connecting pipe (not illustrated) through which the liquid refrigerant 19 is introduced from a refrigerant circulating path. In the rotary compressor 1, compression efficiency of the refrigerant is improved by injecting the liquid refrigerant 19 supplied from the injection pipe 142, to the inside of the upper compression chamber 133T and the inside of the lower compression chamber 133S from each injection hole 140*b* of the intermediate partition plate 140, and by lowering the temperature of the refrigerant during the compression. In the configuration in which the injection hole 140*b* is provided, an amount of the refrigerant in the lower end plate cover chamber 180S8 increases. Therefore, in the modification example, an effect of suppressing noise which is generated when the refrigerant and the lubricant oil 18 are discharged from the inside of the lower end plate cover chamber 180S8 is high.

Above, the embodiments are described, but the embodiments are not limited to the above-described contents. In addition, in the above-described configuration elements, configuration elements which can be easily considered by those skilled in the art, and which are in substantially the same range, that is, a so-called equivalent range, are included. Furthermore, it is possible to appropriately combine the above-described configuration elements. Furthermore, at least any one of various omissions, replacements, and changes of the configuration elements can be performed within a range which does not depart from the scope of the embodiments.

What is claimed is:

1. A rotary compressor comprising:

a sealed vertically-placed cylindrical compressor housing in which a discharging pipe of a refrigerant is provided in an upper portion, and an inlet pipe of the refrigerant is provided in a lower portion;

a compressing unit which is disposed in the lower portion of the compressor housing, and which compresses the refrigerant suctioned from the inlet pipe, and which discharges the refrigerant to the discharging pipe; and a motor which is disposed in the upper portion of the compressor housing, and which drives the compressing unit, wherein the compressing unit includes an annular upper cylinder and an annular lower cylinder, an upper end plate which closes an upper side of the upper cylinder, a lower end plate which closes a lower side of the lower cylinder, an intermediate partition plate which is disposed between the upper cylinder and the lower cylinder, and which closes the lower side of the upper cylinder and the upper side of the lower cylinder, a rotation shaft which is rotated by the motor, an upper eccentric portion and a lower eccentric portion which are provided on the rotation shaft and which are arranged with a phase difference of 180° therebetween, an upper piston which is fitted to the upper eccentric portion, and which revolves along an inner circumferential surface of the upper cylinder, and which forms an upper cylinder chamber on an inside of the upper cylinder, a lower piston which is fitted to the lower eccentric portion, revolves along an inner circumferential surface of the lower cylinder, and which forms a lower cylinder chamber on an inside of the lower cylinder, an upper vane which protrudes to the inside of the upper cylinder chamber from an upper vane groove provided in the upper cylinder, and which divides the upper cylinder chamber into an upper inlet chamber and an upper compression chamber by abutting against the upper piston, a lower vane which protrudes to the inside of the lower cylinder chamber from a lower vane groove provided in the lower cylinder, and which divides the lower cylinder chamber into a lower inlet chamber and a lower compression chamber by abutting against the lower piston, an upper end plate cover which covers the upper end plate, and which forms an upper end cover plate chamber between the upper end plate and the upper endplate cover, and which has an upper end plate cover discharge hole that communicates with the upper end plate cover chamber and an inside of the compressor housing, a lower endplate cover which covers the lower end plate, and which forms a lower endplate cover chamber between the lower end plate and the lower end plate cover, an upper discharge hole which is provided in the upper end plate, and which communicates with the upper compression chamber and the upper end plate cover chamber, a lower discharge hole which is provided in the lower end plate, and which communicates with the lower compression chamber and the lower end plate cover chamber, and a refrigerant path hole which penetrates the lower end plate, the lower cylinder, the intermediate partition plate, the upper end plate, and the upper cylinder, and which communicates with the lower end plate cover chamber and the upper end plate cover chamber, wherein a communication groove, which communicates with the lower end plate cover chamber, is provided on a mating surface between the lower end plate and the lower end plate cover, wherein the lower end plate cover is formed in a shape of a flat plate, and has a through hole that is provided to penetrate in a thickness direction of the lower end plate cover and that communicates with the communication groove, wherein, when 1) a sectional area of the communication groove seen from cross-sectional view taken along a center line of the rotation shaft is S1 [$mm^2$], 2) an area of an overlapping portion in which the through hole and the communication groove overlap each other on a plane orthogonal to the rotation shaft is S2 [$mm^2$], and 3) a displacement volume of the lower cylinder chamber is V[cc], each of $0.10<(52/V)<0.50$, and $1.0<(S2/S1)<7.0$ is satisfied, and wherein lubricant oil and the refrigerant remaining in the lower end plate cover chamber are discharged from the through hole into the lower portion of the inside of the compressor housing through the communication groove and the overlapping portion.

2. The rotary compressor according to claim 1, wherein the compressing unit has an injection hole which communicates with the lower cylinder chamber, and which injects a liquid refrigerant into the inside of the lower cylinder chamber.

3. The rotary compressor according to claim 1, wherein the communication groove is provided in the lower end plate cover.

4. The rotary compressor according to claim 3, wherein a sectional shape of the communication groove is a V groove.

5. The rotary compressor according to claim 1, wherein a bolt, which fastens the lower end plate and the lower cylinder to each other, is inserted into the through hole.

* * * * *